US010837730B1

(12) United States Patent
Hu

(10) Patent No.: US 10,837,730 B1
(45) Date of Patent: Nov. 17, 2020

(54) BALLISTIC ADJUSTMENT DEVICE FOR TOY GUN

(71) Applicant: Shih-Che Hu, Tainan (TW)

(72) Inventor: Shih-Che Hu, Tainan (TW)

( * ) Notice: Subject to any disclaimer, the term of this patent is extended or adjusted under 35 U.S.C. 154(b) by 0 days.

(21) Appl. No.: 16/683,196

(22) Filed: Nov. 13, 2019

(30) Foreign Application Priority Data

Jul. 25, 2019 (TW) ..... 108209699

(51) Int. Cl.

| | |
|---|---|
| ***F41B 11/00*** | (2013.01) |
| ***F41A 21/16*** | (2006.01) |
| ***F41A 21/20*** | (2006.01) |
| *F41B 7/08* | (2006.01) |
| *A63B 69/40* | (2006.01) |

(52) U.S. Cl.
CPC ..... *F41A 21/16* (2013.01); *F41A 21/20* (2013.01); *F41B 11/00* (2013.01); *A63B 2069/402* (2013.01); *F41B 7/08* (2013.01)

(58) Field of Classification Search
CPC ..... A63B 2069/402; F41B 11/00
See application file for complete search history.

(56) References Cited

U.S. PATENT DOCUMENTS 2,182,369 A * 12/1939 Barron ..... A63B 69/409 124/81
3,662,729 A * 5/1972 Henderson ..... A63B 69/409 124/73
4,091,791 A * 5/1978 Castelli ..... A63B 69/409 124/44.7
4,323,047 A * 4/1982 McIntosh ..... A63B 69/406 124/1
5,413,085 A * 5/1995 Kraeft ..... A63B 69/40 124/1
5,655,510 A * 8/1997 Kunimoto ..... F41B 11/00 124/81
5,823,173 A * 10/1998 Slonaker ..... F41A 21/00 124/56

* cited by examiner

*Primary Examiner* — John A Ricci

(74) *Attorney, Agent, or Firm* — Raymond Y. Chan; David and Raymond Patent Firm

(57) ABSTRACT

A ballistic adjustment device for toy gun, includes a mounting member having a bearing portion located above a bullet barrel. When the mounting member moves up and down, a pressure member is released from or pressed against the bullet barrel to move a protruding portion of the bullet barrel up and down. A connecting rod is pivoted to a lower part of the mounting member and has a press portion that is pressed against an inclined surface of the rotary member. The rotary member is in communication with a magazine seat, such that the rotary member can be turned only by extending the operator's finger into the magazine seat, which makes the press portion moves high and low on the inclined surface, so as to move the connecting rod and the mounting member, and make the bearing portion move up and down to achieve the function of adjusting the trajectory.

5 Claims, 6 Drawing Sheets

BALLISTIC ADJUSTMENT DEVICE FOR TOY GUN

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a ballistic adjustment device for toy gun, in particular, the ballistic adjustment function can be achieved as long as the user operates a knob from the inside of a magazine seat.

Description of Related Arts

A gun barrel of a toy gun is mainly used as a channel for the placement and firing of a bullet (commonly known as a BB bomb). In view of the cost and structural complexity, there is no spiral line (commonly known as a rifling) structure in the gun barrel which can guide the rotation of the bullet, so that after the bullet of the toy gun is fired, the moving track of the non-directional rotation is caused, and the firing trajectory is difficult to control. Therefore, it is often impossible to shoot the target accurately. In view of above, toy guns with ballistic adjustment function are developed, such as Taiwan Patent Publication Nos. 299663, M298109 and I416060, which are all equipped with a ballistic adjustment device. The main technique is to combine a flexible bullet barrel at a rear end of a gun barrel and provide a protruding portion at a top end of an inner wall of the bullet barrel, so that a bullet can be rubbed when it passes through the protruding portion, so as to make the trajectory stable.

For example, according to the Taiwan Patent Publication No. I416060, when adjusting the trajectory, a rotating seat 40 must be turned (as shown in FIG. 1). However, since the rotating seat 40 is contained in the interior of a gun body, several components of the gun body must be disassembled before adjustment and assembled after adjustment. Therefore, the operation procedure is more complex and dangerous.

The present invention mitigates and/or obviates the aforementioned disadvantages.

SUMMARY OF THE PRESENT INVENTION

The primary objective of the present invention is to provide a ballistic adjustment device for toy gun, which improves the complicated operation procedure of ballistic adjustment of a conventional toy gun.

The ballistic adjustment device for toy gun of the present invention comprises a gun body axially combined with a gun barrel at a front end thereof. The gun barrel has an end notch at a rear end thereof. A lower side of the gun body is combined with a magazine seat. A ballistic adjustment device is installed in the rear end of the gun barrel and at least comprises a bullet barrel and a pressure member. The bullet barrel, which is made of a flexible material and attached to the rear end of the gun barrel, comprises at least one protruding portion located on the inside wall thereof corresponding to the end notch of the gun barrel. The pressure member is disposed above the bullet barrel and is pressed on the protruding portion of the bullet barrel. The ballistic adjustment device further comprises a mounting member, a connecting rod and a rotary member. The mounting member has a bearing portion properly located above the bullet barrel, and the pressure member is located between the bearing portion and the bullet barrel, such that when the bearing portion moves up and down, the pressure member can be released from or pressed against the bullet barrel so as to move the protruding portion up and down, achieving the object of adjusting the trajectory. The connecting rod is pivoted to a lower part of the mounting member and has a press portion at a rear end thereof. The press portion is pressed against an inclined surface of the rotary member, and the rotary member is in communication with the magazine seat, such that the rotary member can be turned only by extending the operator's finger into the magazine seat, and, at that time, the press portion can move high and low on the inclined surface, so as to move the connecting rod and the mounting member. Then, the bearing portion is made to move up and down to achieve the function of adjusting the trajectory, thus avoiding the trouble of disassembling a conventional gun body.

The mounting member has a vertical ring-shape and the bearing portion is located at a top center of the mounting member. A bottom of the bearing portion is a recessed portion defined with a through hole. The pressure member is provided with a mounting block and a ring block. A top end of the mounting block is a projecting end that is received in the through hole, and a lower part of the mounting block is provided with a mounting seat for installation of the ring block. The ring block is disposed above the protruding portion of the bullet barrel.

In addition, the inclined surface, located at a top surface of the rotary member, is a ring slope with a lowest part and a highest part. A partition wall is provided between the lowest part and the highest part.

Moreover, when the press portion of the connecting rod is pressed to the lowest part of the inclined surface, the bearing portion moves up to the highest point. At that time, the pressure member is released from the bullet barrel to move the protruding portion upwardly. When the press portion of the connecting rod is pressed to the highest part of the inclined surface, the bearing portion moves down to the lowest point. AT that time, the pressure member is pressed against the bullet barrel to move the protruding portion downwardly.

Therefore, when going to adjust the ballistic range, remove the magazine and extend into the magazine seat by a finger to turn the rotary member. At that time, since the rotary member is in communication with the magazine seat, and by the linkage of the components, the protruding portion of the bullet barrel can move up or down to achieve the function of adjusting the trajectory, improving the convenience of ballistic adjustment operation.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENT

Figure 1:
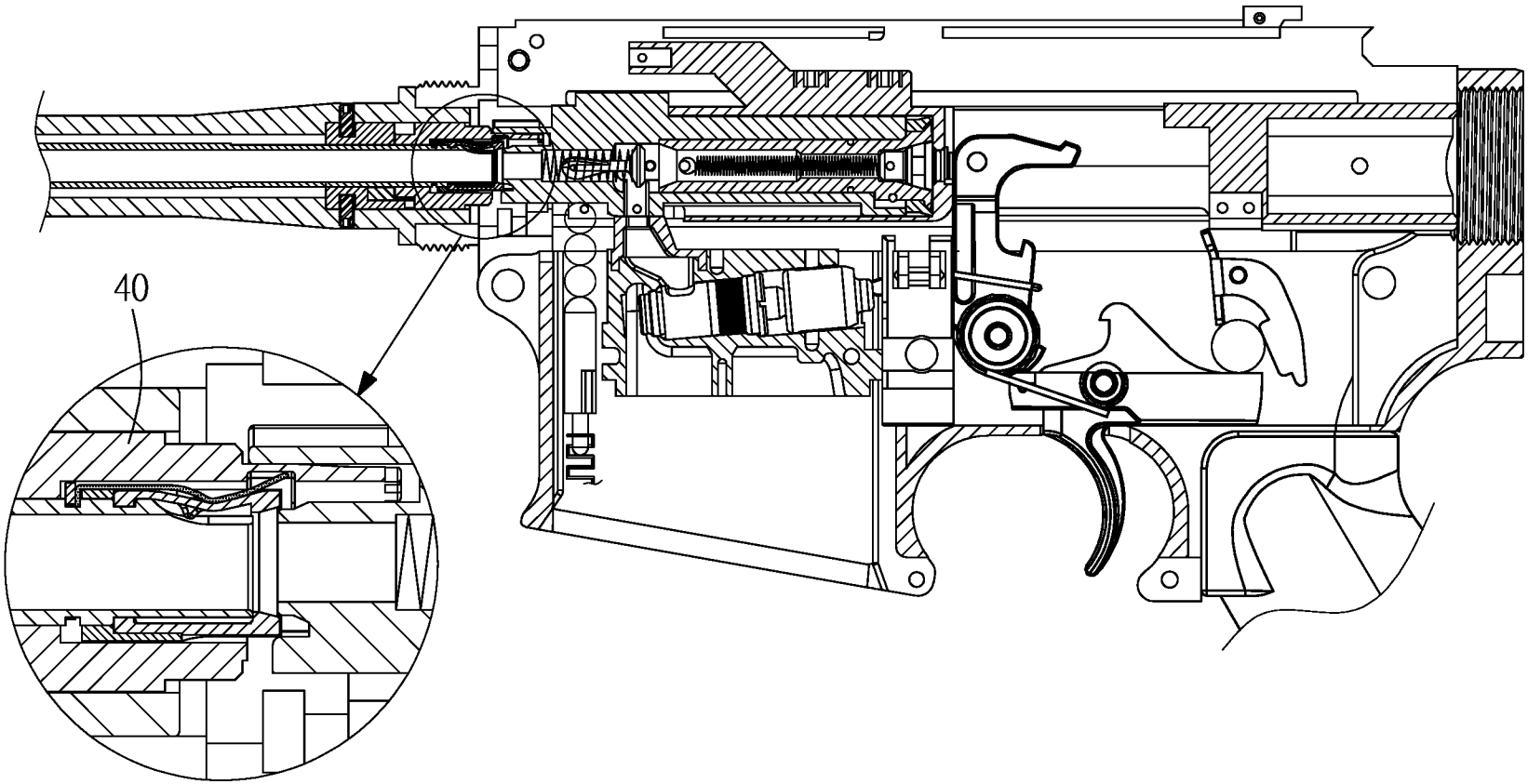
FIG. 1 (PRIOR ART)
FIG. 1 is a partial sectional enlarged view of a conventional ballistic adjustment device being assembled into a toy gun.
Figure 2:
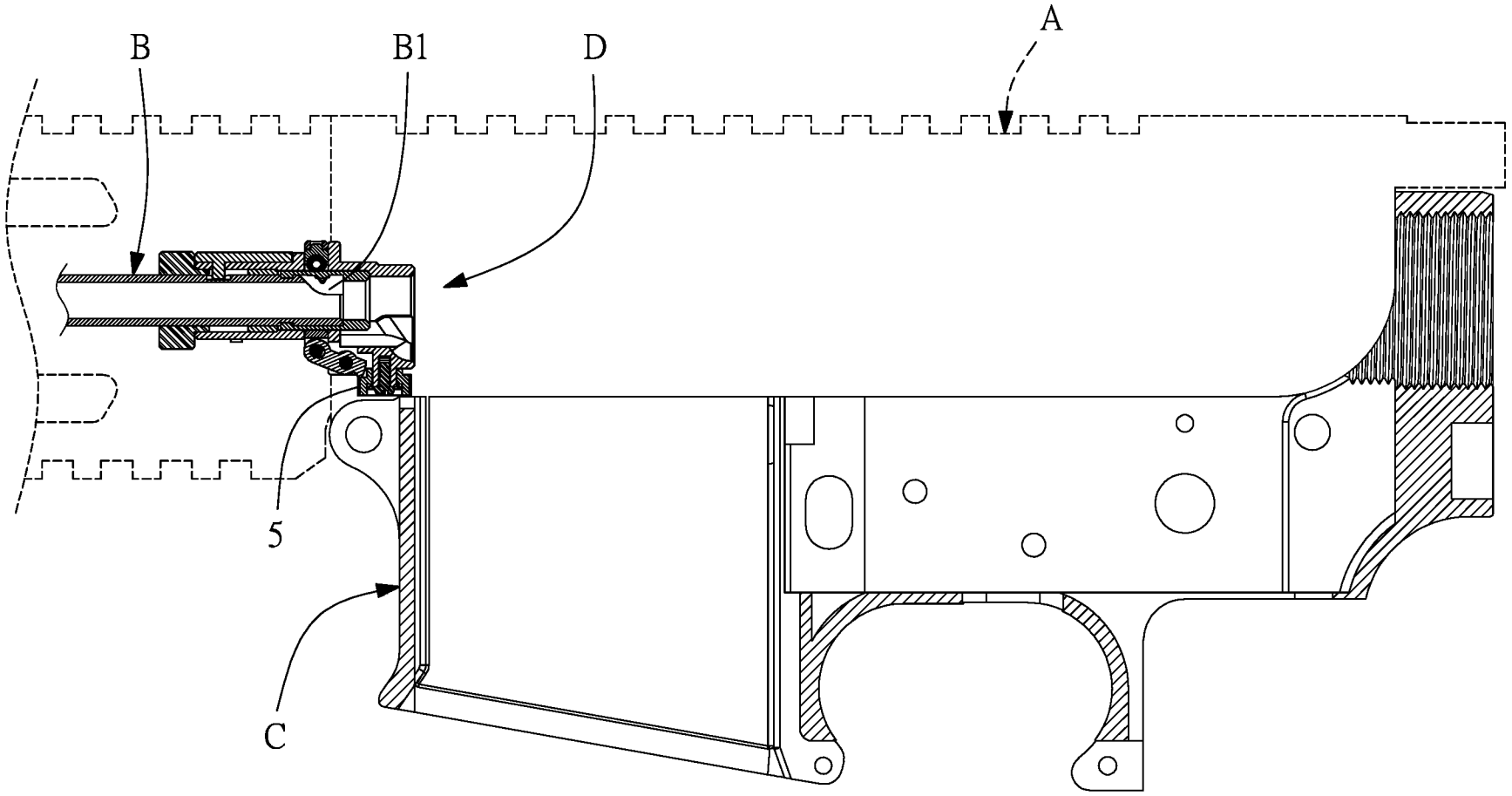
FIG. 2 is a partial sectional view of a ballistic adjustment device for toy gun in accordance with a preferred embodiment of the present invention.
Figure 3:
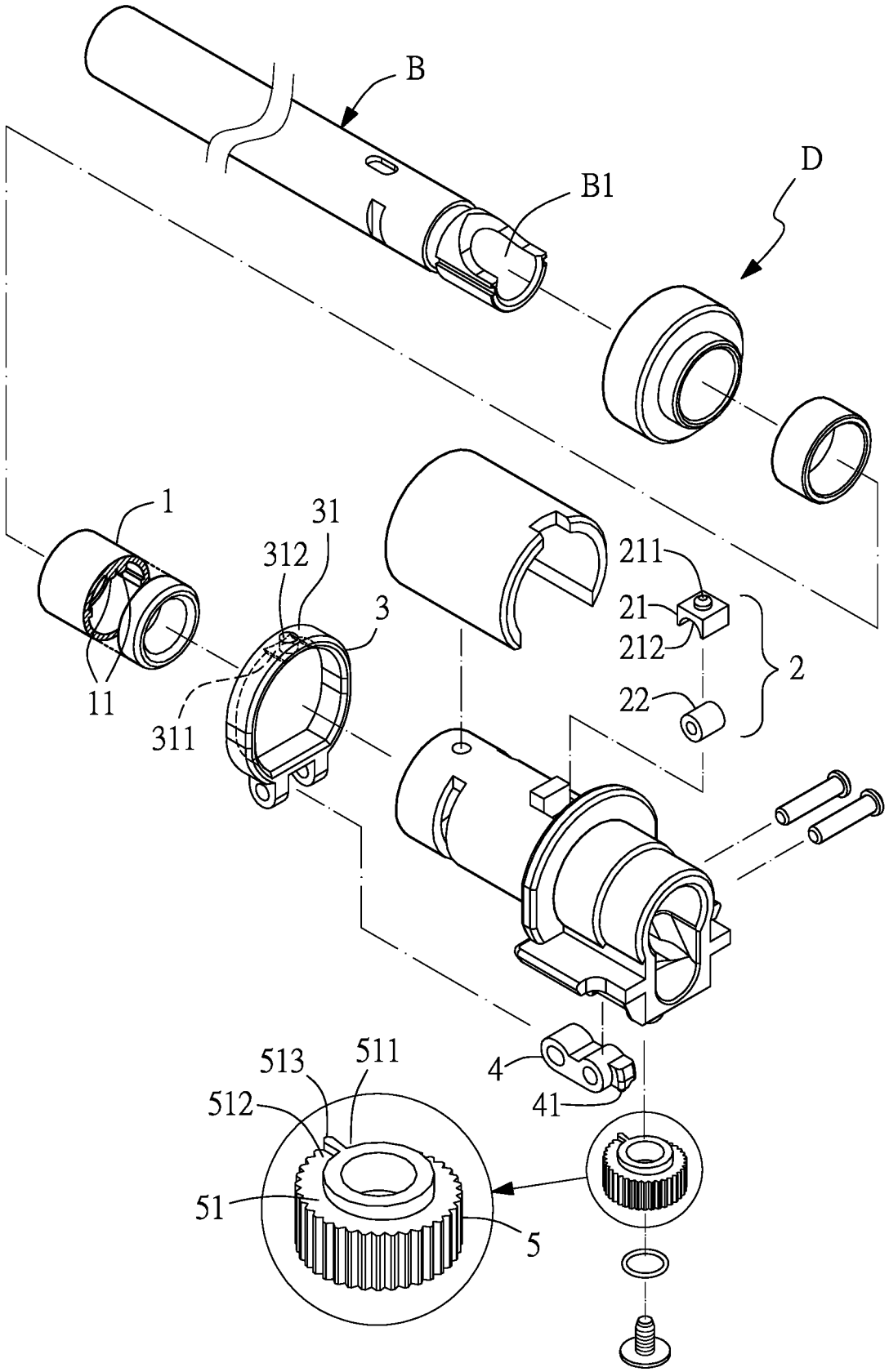
FIG. 3 is an exploded view of the ballistic adjustment device for toy gun in accordance with the above preferred embodiment of the present invention.
Figure 4:
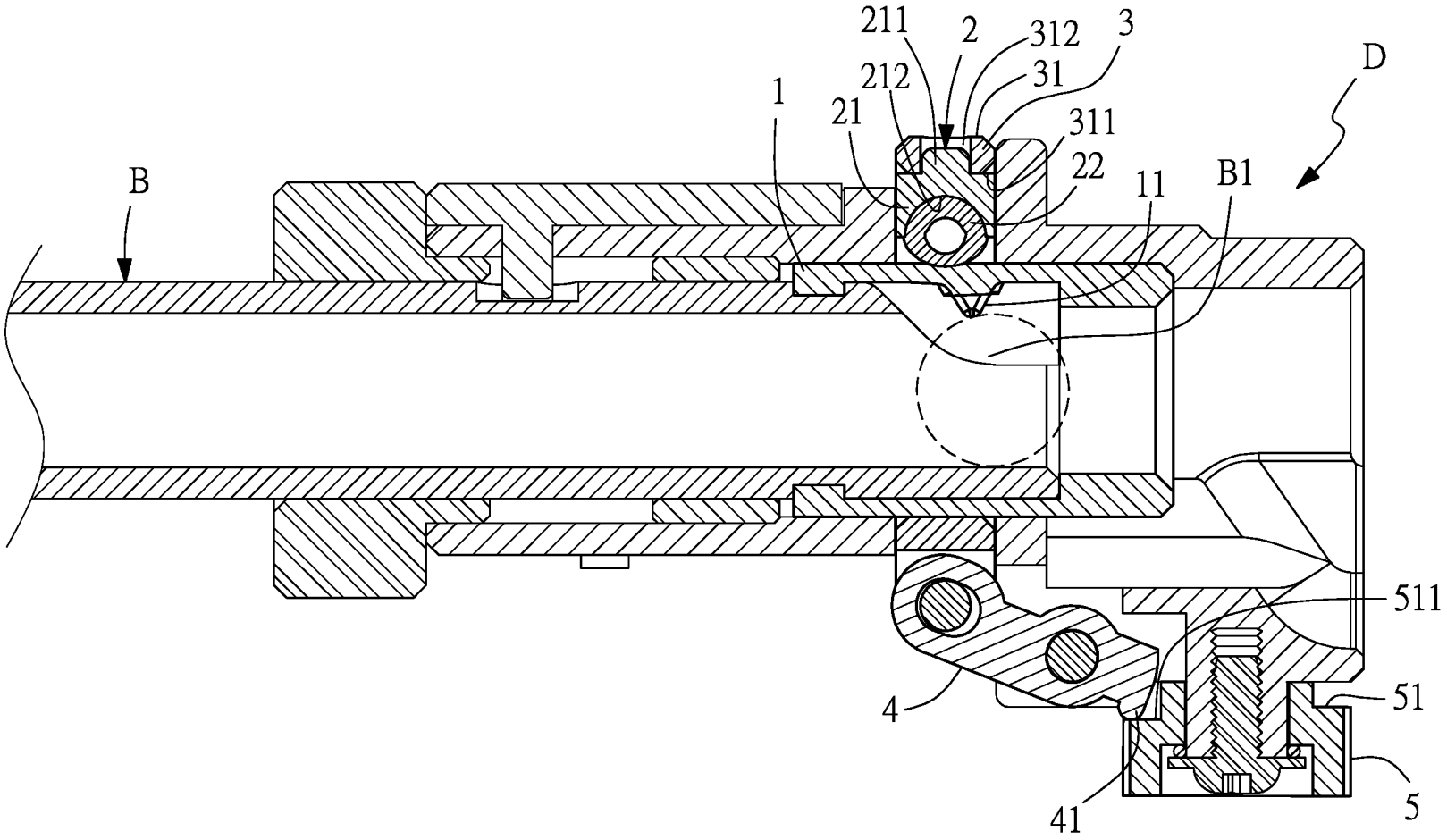
FIG. 4 is an assembly sectional view of the ballistic adjustment device for toy gun in accordance with the above preferred embodiment of the present invention.

Referring to FIG. 2, a toy gun in accordance with a preferred embodiment of the present invention comprises a gun body A axially combined with a gun barrel B (especially for an inner gun barrel) at a front end thereof. The gun barrel B has an end notch B1 at a rear end thereof. A lower side of the gun body A is combined with a magazine seat C. A ballistic adjustment device D is installed in the rear end of the gun barrel B. Referring to FIGS. 3 and 4, the ballistic adjustment device D comprises a bullet barrel 1, a pressure member 2, a mounting member 3, a connecting rod 4, and a rotary member 5.

The bullet barrel 1 (as shown in FIG. 3), which is made of a flexible material (for example, rubber or plastics) and attached to the rear end of the gun barrel B (as shown in FIG. 4), comprises at least one protruding portion 11 located on the inside wall thereof corresponding to the end notch B1 of the gun barrel B (as shown in FIG. 3, taking two protruding portions as an example).

The pressure member 2 (as shown in FIGS. 3 and 4) is disposed above the bullet barrel 1 and is pressed on the protruding portion 11 of the bullet barrel 1. The pressure member 2 is provided with a mounting block 21 and a ring block 22. A top end of the mounting block 21 is a projecting end 211, and a lower part of the mounting block 21 is provided with a mounting seat 212 for installation of the ring block 22. The ring block 22 is disposed above the protruding portion 11 of the bullet barrel 1.

The mounting member 3 (as shown in FIG. 3) has vertical ring-shape and has a bearing portion 31 at a top center thereof. A bottom of the bearing portion 31 is a recessed portion 311 defined with a through hole 312 for receiving the projecting end 211 (as shown in FIG. 4), so as to make the bearing portion 31 properly located above the bullet barrel 1, and the pressure member 2 located between the bearing portion 31 and the bullet barrel 1, such that when the bearing portion 31 moves up and down, the pressure member 2 can be released from or pressed against the bullet barrel 1 so as to move the protruding portion 11 up and down, achieving the object of adjusting the trajectory.

The connecting rod 4 (as shown in FIGS. 3 and 4) is pivoted to a lower part of the mounting member 3 and has a press portion 41 at a rear end thereof. The connecting rod 4 is used for linking the mounting member 3.

Figure 5:
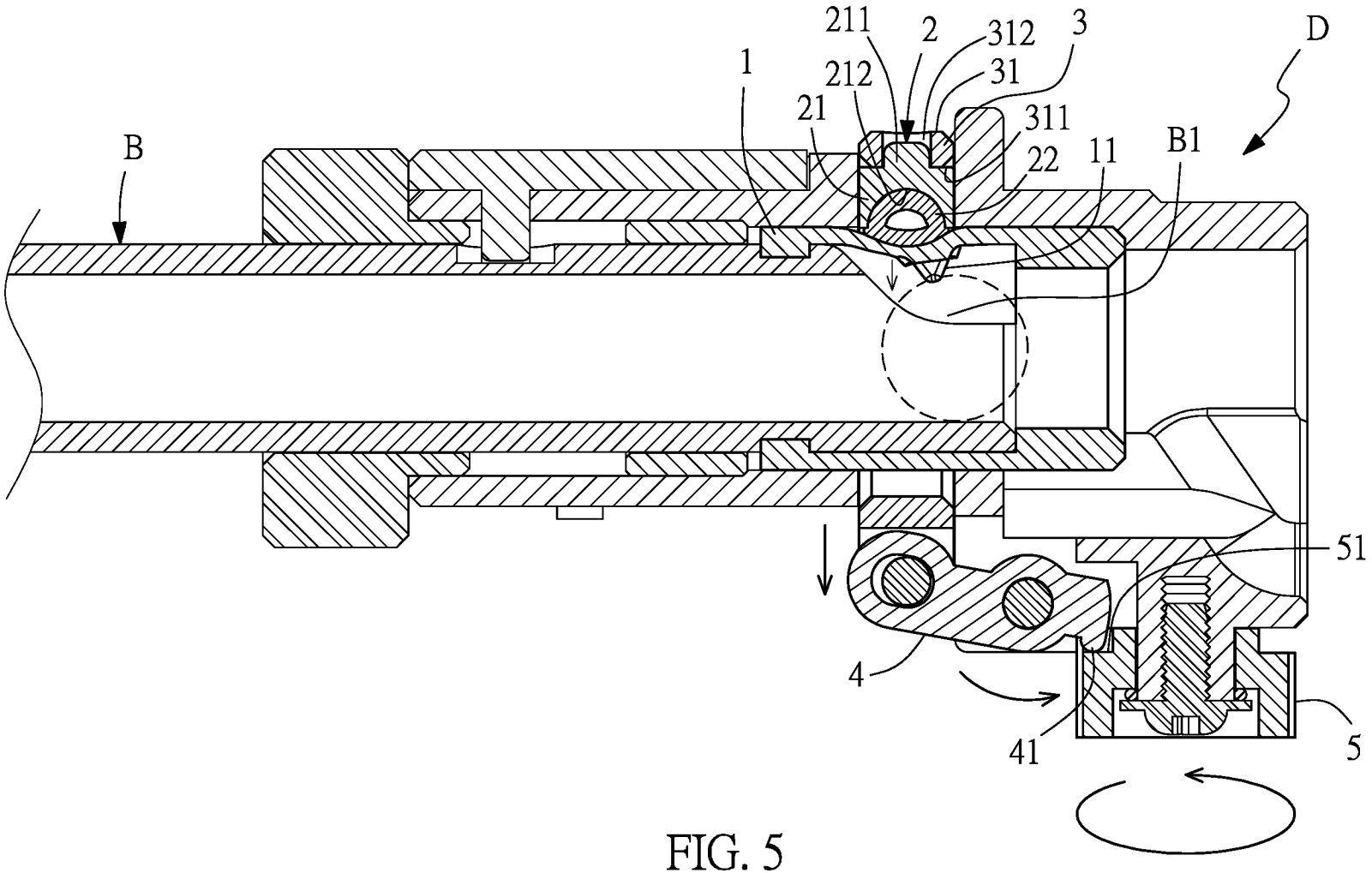
FIG. 5 is another assembly sectional view of the ballistic adjustment device for toy gun in accordance with the above preferred embodiment of the present invention.
Figure 6:
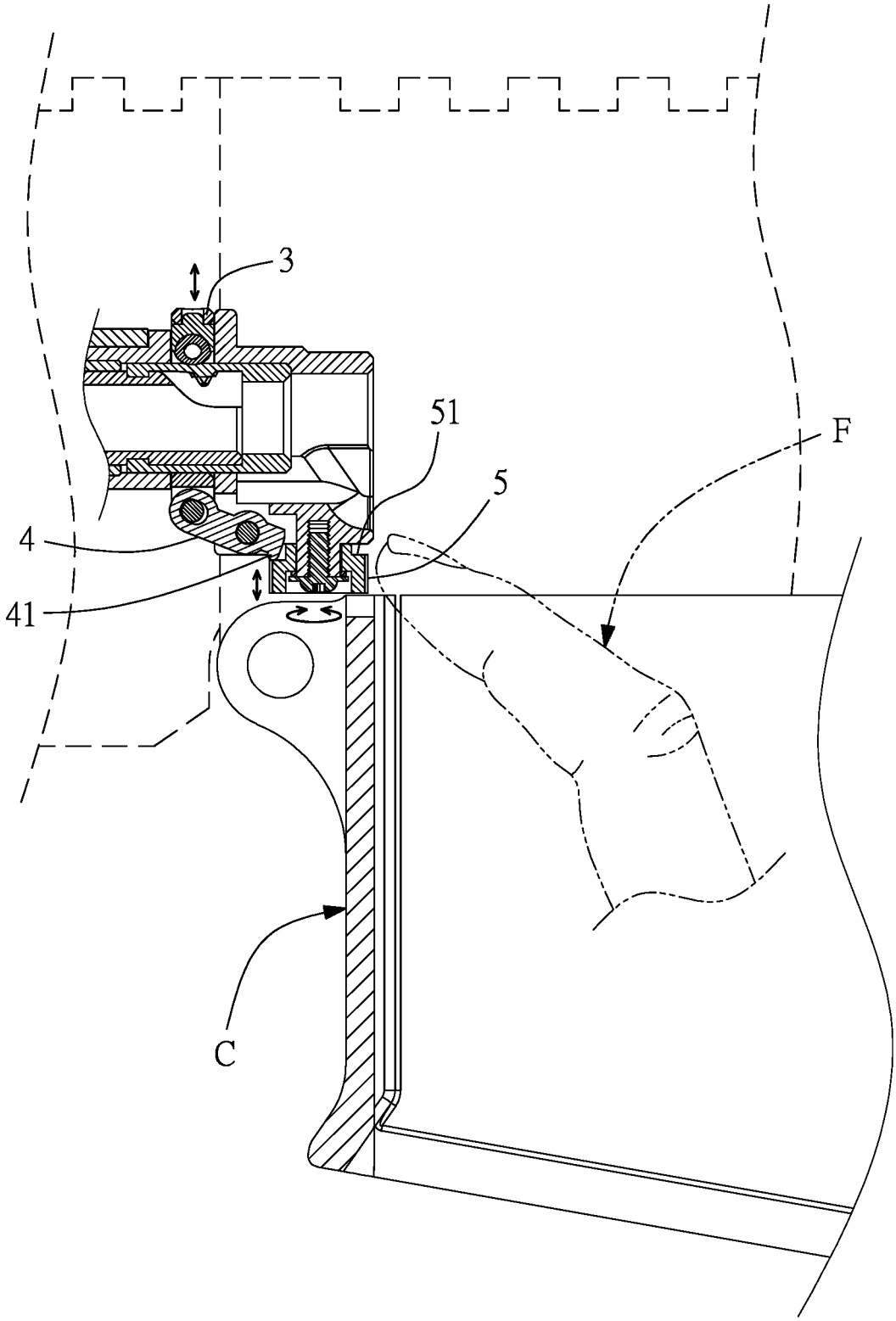
FIG. 6 is an operational view of the ballistic adjustment device for toy gun in accordance with the above preferred embodiment of the present invention.

The rotary member 5 is in communication with the magazine seat C (as shown in FIG. 2), and can be turned only by extending the operator's finger into the magazine seat C (as shown in FIG. 6). A top surface of the rotary member 5 is provided with an inclined surface 51 (as shown in FIG. 3) that is a ring slope with a lowest part 511 and a highest part 512. A partition wall 513 is provided between the lowest part 511 and the highest part 512. The press portion 41 is pressed against the inclined surface 51 (as shown in FIG. 4). Thereby, when turning the rotary member 5, the press portion 41 can move high and low on the inclined surface 51 (as shown in FIG. 4), so as to move the connecting rod 4 and the mounting member 3, and then make the bearing portion 31 move up and down, thus adjusting the trajectory (as shown in FIGS. 4 and 5). For example, when the press portion 41 of the connecting rod 4 is pressed to the lowest part 511 of the inclined surface 51, the bearing portion 31 moves up to the highest point (as shown in FIG. 4). At that time, the pressure member 2 is released from the bullet barrel 1 to move the protruding portion 11 upwardly. When the press portion 41 of the connecting rod 4 is pressed to the highest part 512 of the inclined surface 51 (not shown), the bearing portion 31 moves down to the lowest point. AT that time, the pressure member 2 is pressed against the bullet barrel 1 to move the protruding portion 11 downwardly (FIG. 5 simply refers to the downward movement).

Referring to FIG. 6, when going to adjust the ballistic range, remove the magazine (not shown) and extend into the magazine seat C by a finger F of a user to turn the rotary member 5. At that time, since the press portion 41 moves high and low on the inclined surface 51, the connecting rod 4 and the mounting member 3 can be moved to make the bearing portion 31 move up and down for adjusting the trajectory. Compared with the conventional operation method, it is very convenient. The operation procedure of ballistic adjustment is simplified, which is the most important effect of the present invention.

As stated above, it can be seen that rotary member 5 of the present invention is in communication with the magazine seat C, and the finger F is extended into the magazine seat C to turn the rotary member 5, and by the linkage of the connecting rod 4 and the mounting member 3, the mounting member 3 can move up and down to achieve the function of adjusting the trajectory, which can avoid the trouble of disassembling a conventional gun body.

While we have shown and described various embodiments in accordance with the present invention, it should be clear to those skilled in the art that further embodiments may be made without departing from the scope of the present invention.

What is claimed is:

1. A ballistic adjustment device for toy gun, comprising:

a gun barrel having an end notch defined at a rear end thereof;

a gun body axially combined with the gun barrel at a front end thereof, wherein a lower side of the gun body is combined with a magazine seat; and a ballistic adjustment device being installed in the rear end of the gun barrel and at least provided with a bullet barrel and a pressure member, wherein the bullet barrel, which is made of a flexible material and attached to the rear end of the gun barrel, comprises at least one protruding portion located on an inside wall thereof corresponding to the end notch of the gun barrel, wherein the pressure member is disposed above the bullet barrel and pressed on the protruding portion of the bullet barrel, wherein the ballistic adjustment device further comprises a mounting member, a connecting rod and a rotary member, wherein the mounting member has a bearing portion properly located above the bullet barrel and the pressure member is located between the bearing portion and the bullet barrel, such that when the bearing portion moves up and down, the pressure member is released from or pressed against the bullet barrel so as to move the protruding portion up and down, wherein the connecting rod is pivoted to a lower part of the mounting member and has a press portion at a rear end thereof, wherein the press portion is pressed against an inclined surface of the rotary member while the rotary member is in communication with the magazine seat, such that the rotary member is turned and the press portion moves high and low on the inclined surface, so as to move the connecting rod and the mounting member and make the bearing portion move up and down.

2. The ballistic adjustment device for toy gun as claimed in claim 1, wherein the mounting member has a vertical ring-shape and the bearing portion is located at a top center of the mounting member, wherein a bottom of the bearing portion is provided for receiving the pressure member.

3. The ballistic adjustment device for toy gun as claimed in claim 2, wherein the bottom of the bearing portion is a recessed portion defined with a through hole, wherein the pressure member is provided with a mounting block and a ring block, wherein a top end of the mounting block is a projecting end that is received in the through hole, and a lower part of the mounting block is provided with a mounting seat for installation of the ring block, wherein the ring block is disposed above the protruding portion of the bullet barrel.

4. The ballistic adjustment device for toy gun as claimed in claim 3, wherein the inclined surface of the rotary member is located at a top surface of the rotary member and is a ring slope with a lowest part and a highest part, wherein a partition wall is provided between the lowest part and the highest part.

5. The ballistic adjustment device for toy gun as claimed in claim 4, wherein when the press portion of the connecting rod is pressed to the lowest part of the inclined surface, the bearing portion moves up to the highest point, wherein when the press portion of the connecting rod is pressed to the highest part of the inclined surface, the bearing portion moves down to the lowest point.

* * * * *